United States Patent [19]

Gross

[11] 3,978,873

[45] Sept. 7, 1976

[54] COIN COUNTING APPARATUS

[75] Inventor: Erwin Gross, Karlsruhe, Germany

[73] Assignee: Standardwerk Eugen Reis GmbH, Germany

[22] Filed: July 24, 1975

[21] Appl. No.: 598,814

[30] Foreign Application Priority Data

July 26, 1974 Germany ..... 2436022

[52] U.S. Cl. ..... 133/8 A; 235/92 CN

[51] Int. Cl.[2] ..... G07D 9/00

[58] Field of Search ..... 133/8 R, 8 A, 8 C, 3 A; 235/92 CN

[56] References Cited

UNITED STATES PATENTS 2,881,975 4/1959 Bower ..... 133/8 R

*Primary Examiner*—Allen N. Knowles

[57] ABSTRACT

A star-wheel is arranged adjacent a transport and is indexable about its central axis with respect to a null position on the passage of coins therethrough. A freely rotatable shaft fixed at one end to said star-wheel indexes conjointly therewith, and meshes with means for transmitting the indexing of the shaft to a register. A coupling is located about the shaft, having a first member secured to the shaft and a second member freely rotatable about the shaft and axially movable thereon. The second coupling member has a cam located about its peripheral surface and an axial extension provided with a radially extending flange. A pivotally mounted lever is adapted to tangentially engage the cam, and a pivotally mounted pawl is adapted to engage the flange. The lever is selectively manipulated to cause it to engage the cam to separate the coupling member and cause the second coupling member to rotate into a null position about said shaft. The pawl is selectively manipulated to cause it to engage the flange in the null position.

6 Claims, 3 Drawing Figures

COIN COUNTING APPARATUS

BACKGROUND OF THE INVENTION

The present invention relates to a mechanical counting apparatus for coin-counting machines, token-counting machines and similar disc-counting machines by which during the counting procedure the coins are transported through a star-shaped indexing wheel.

It is known to provide coin-counting machines with a delivery track in which individual coins are moved sequentially one behind the other into and through an indexing star-wheel so that each individual coin is received within a tooth of the star wheel causing it to rotate in direct relationship to the passage of coins and to thereby trip or activate an adding register, in which the number of indexes can be recorded.

When, however, the known counting machines are arranged to operate in combination with an automatic packing machine, in which the coins are packed in rolls or bags, then it is necessary, above all else, to space the flow of coins at predetermined intervals, so that after each cycle in which a predetermined number of coins required for a roll or a container have been counted, the further transport of coins can be interrupted to allow the completion of packaging. Thereafter the flow of coins must be restarted for the next cycle. Apparatus has been disclosed in German Patent publication DT-PS 876,174, which, in combination with an adjustable register, is capable of stopping the transport of coins after a given count or number of coins has been reached. This apparatus operates, however, under a high mechanical effort with a multiplicity of ratchets, pawls, spring tongues or levers, switch arms and cog wheels. The apparatus is consequently so complicated that the mechanism breaks down after only a very short time. It is furthermore comparatively difficult to maintain.

With the general development of electronic switching and control elements there has also been developed electronic control means for coin counting machines which seeks to reduce the use of complicated mechanical devices. As a result, the cutoff impulse by which the flow of coins may be brought to a stop, after reaching a given count, as with an adder-register, is obtained over a preprogrammed digital circuit of an electronic computer. Such electronic control devices, for coin counting machines, when measured by their combined cost in comparison to other available mechanical apparatus, are too expensive, since they are not operative over normal line voltage but must instead be provided with complex electrical apparatus, interposed between the line voltage and the control apparatus, for reducing the voltage and/or for rectifying voltage. A more significant disadvantage, however lies in the inability to install machines, which are so equipped, in countries having a low level of technology since even a little disturbance in the electronic control system can drive the machine to a break down and because no correspondingly trained personnel exist for the quick repair and maintenance.

In the known coin-counting machines a further difficult problem exists, mainly, in the need to always reset the mechanism in an exact position corresponding to the initial starting position for each cycle (Null position) so that a subsequent counting cycle can begin. For example, it is necessary to reset the machine after each interruption in the operation of the machine, after the consumption of the coin stock, after correction of disturbances caused by counterfeit coins or upon the daily start-up of operation. In order to obtain this exact initial starting position it is necessary, in the known mechanical apparatus to manually bring the indexing star-wheel to a given or marked Null position, or, in the known electronic apparatus to provide expensive supplementary switching elements, resulting in more costly and more complicated equipment.

Accordingly, it is object of the present invention to provide a simple more functional mechanical counting apparatus having a greater efficiency and assurance of operation and which is easy to maintain. In addition it is an object of the present invention to provide a coin counting machine in which the Null positioning is automatically obtained and by which the disadvantages of the known apparatus are avoided.

The foregoing objects together with other objects and advantages will be apparent from the following disclosure.

SUMMARY OF THE INVENTION

According to the present invention a coin counting machine is provided wherein a row of coins, carried on a transporting track, pass through an indexable star-wheel. On the passage of the coins, the star-wheel causes the activation of a mechanical adder or register wherein the number of coins are counted. The register is adjustable and may be preset to count a given number of coins and is provided with means to provide an indication of the completion of the count of the cycles so as to halt the transport of the coins. The register is also provided with a switch by which an impulse is generated upon reaching a predetermined number within the count, less than the number present in the register for the given cycle, (X before Null) which impulse is adapted to activate a mechanical member which after the further indexing of the star-wheel to complete the count in the cycle arrests the star-wheel. Stopping of the star-wheel at that point places the star-wheel in a Null position indicative of both the end of the cycle and of the beginning of the next cycle of operation.

Preferably the adder-register is set so that the stopping impulses are obtained upon reaching the fourth from the last count in the cycle (four before Null). The indexing star-wheel is also arranged so that it completes a revolution about its longitudinal axis on the passage of every four coins. The star-wheel thus is provided with four teeth or recesses for receiving the coins as they move along the track. These parameters and relationships may however be varied to suit the given needs of the counting installation. Such arrangement as described permits the counting of coins in intervals of five. Other parameters will permit the counting of the coins at other intervals.

The star-wheel is mounted at the end of a shaft and is adpated to lie adjacent the coin transport track partially within the path of the coins. Mounted on the shaft is a bevel gear which meshes with a second bevel gear secured to the end of a flexible rod, extending into the adder-register so that the rotational indexing of the star-wheel is transmitted through the shaft and the flexible rod to the register. Mounted also on the shaft is a coupling comprising an upper portion which is fixed to the shaft and a lower portion which is rotatable about the shaft and axially movable along the shaft. The two portions of the coupling are provided with mating and meshing teeth. The lower coupling portion is provided with a crown cam contoured about its peripheral surface and a cylindrical axial extension in which a radially extending flange is formed. A pivotable lever is mounted adjacent the coupling having a roller at one end adapted to be movable onto the cam surface and cooperable with the contour of the cam surface to cause the opening of the coupling. Mounted adjacent the cylindrical extending portion is a pawl which is pivotable into and out of the path of the flange formed on a cylindrical extension of the lower coupling portion. The pawl when placed within the path of the flange prevents rotation of the coupling and thereby the shaft on which the coupling is mounted. The pawl is activated on the signal impulse from the register, obtained on reaching the fourth before the Null position, thereby permitting a further signal rotation of the star-wheel and thus the completion of the counting cycle. The lever on the other hand is activated on the start of the next cycle and causes disengagement of the coupling in the event the star-wheel is not at a Null position, simultaneously causing rotation of the lower coupling portion into the Null position.

To activate the cam follower roller in order to open the coupling and for simultaneously turning the stop cam to its initial starting position (Null position), a magnetic or solenoid motor is arranged at the free end of the transmission lever. To activate the stop pawl, against which the stop flange engages, at the end of a counting cycle and by which the fixing of the Null position is accomplished, a similar magnetic or solenoid is provided at the free end of the stop pawl.

With the inventive features of the present invention, a coin-counting machine can be provided in which all of its counting cycles can be accomplished in multiples of five and after each cycle and for that matter after each stopping point, the machine is capable of starting over again from a Null position, which exactly coincides with the beginning next counting cycle. The special advantages of the present invention lie therefore in the simplicity of the apparatus, its cheapness of manufacture and easily maintainability and servicability. Above all at no time is it required to specially reset the star-wheel by hand.

Full details of the present invention are set forth in the following description and are illustrated in the accompanying drawings.

BRIEF DESCRIPTION OF THE DRAWINGS

IN THE DRAWINGS

Figure 1:
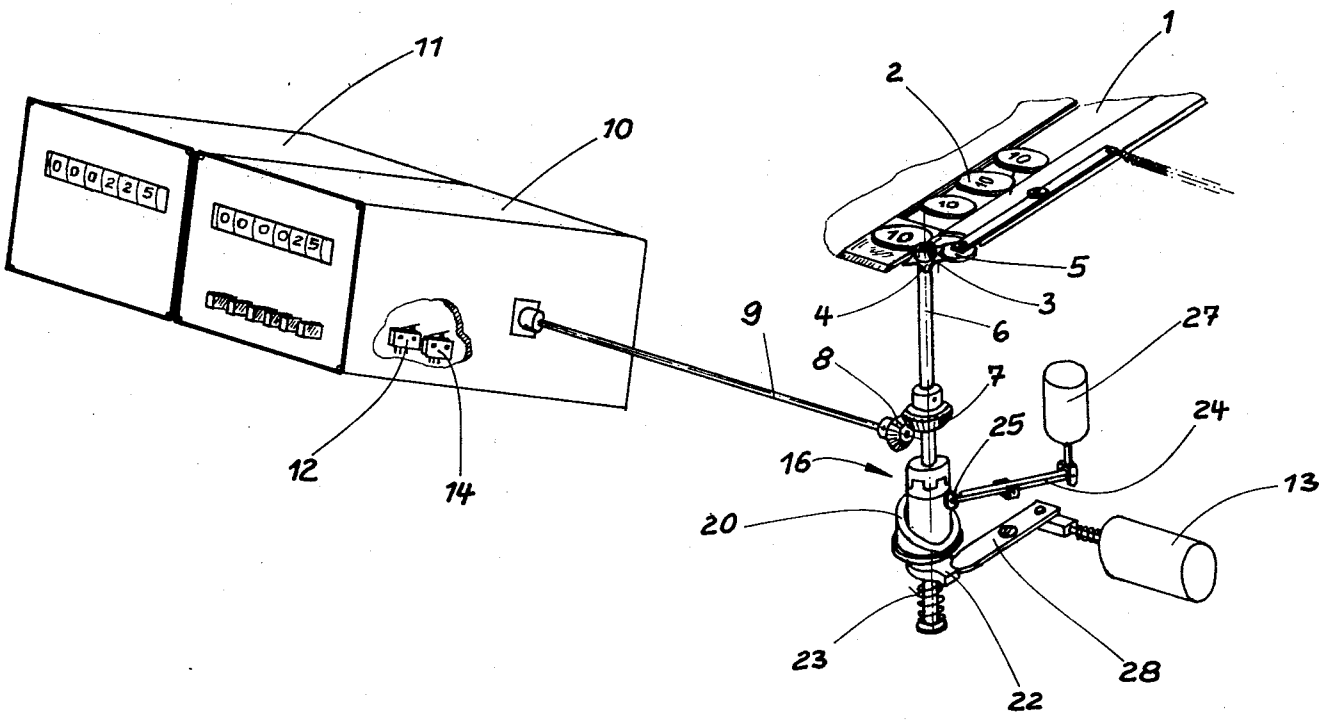
Figure 2:
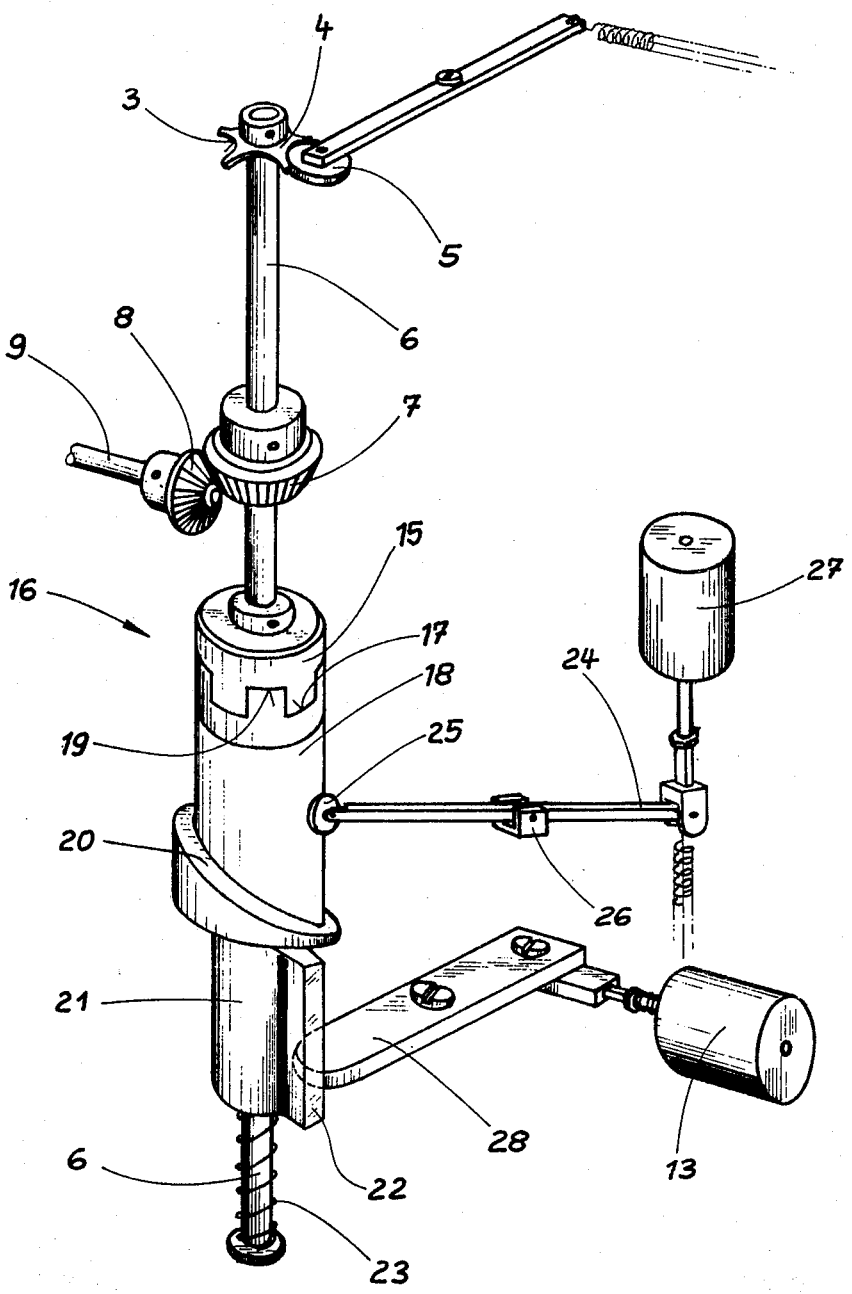
Figure 3:
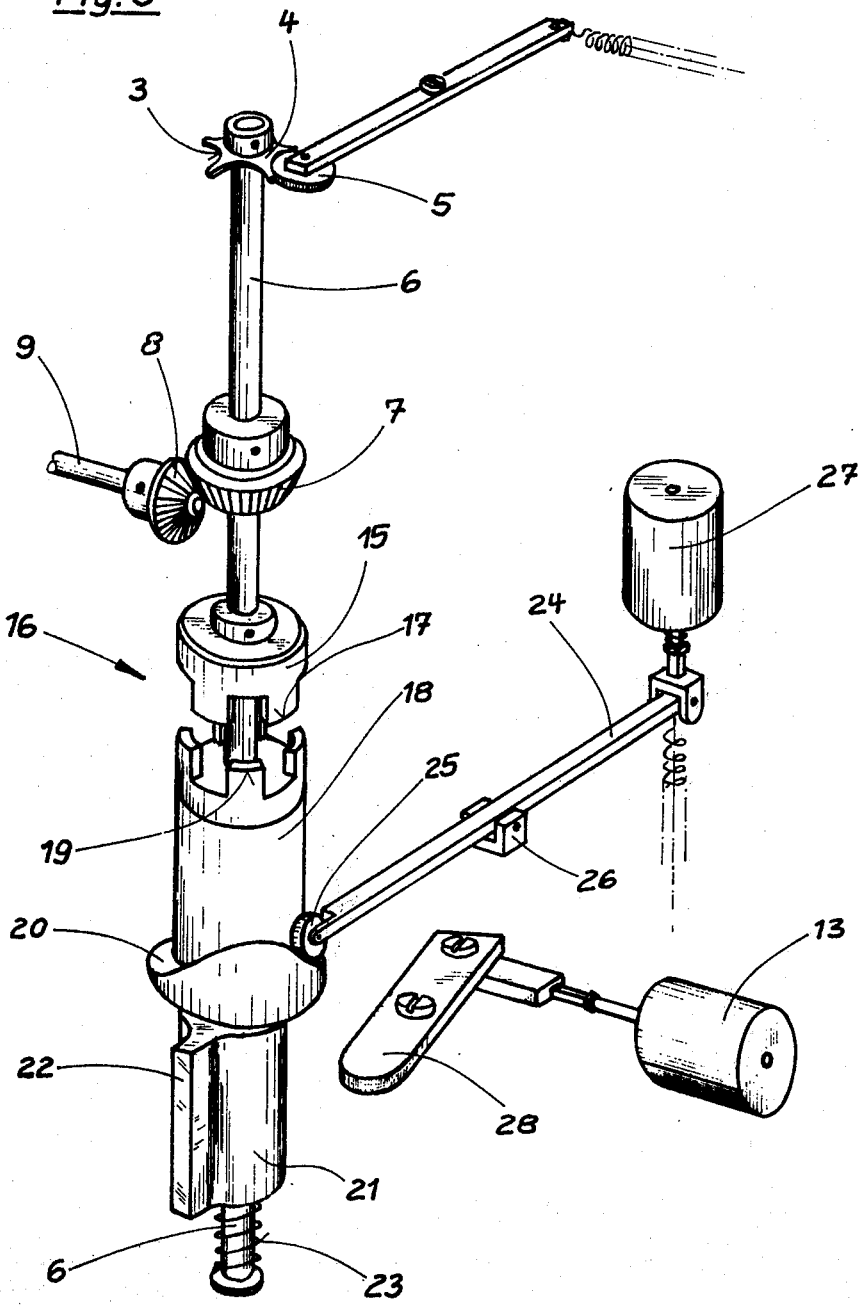

FIG. 1 is a perspective view showing schematically the arrangement of the counting apparatus, of the present invention, FIG. 2 is an enlarged view of the counting apparatus shown in FIG. 1 at the end of a regular counting cycle, i.e. in the Null position, FIG. 3 is a view similar to that of FIG. 2 showing the position of the apparatus after interruption of the counting cycle before reaching the Null position.

DESCRIPTION OF THE INVENTION

The coin counting apparatus, as seen in FIG. 1 is provided with a transport drive comprising a track, generally indicated by the numeral 1 which serves to carry and feed a row of coins 2. The track 1 sits in a longitudinal slot in the transport drive and is movable by conventional methods as for example, the use of a drive roller or a belt drive device connected to a suitable motor so as to carry the coins in single file. Extending laterally into the slot is a star-wheel 4 having a plurality of teeth, each adapted to receive a coin; the moving coins acting to index the star wheel. To secure an exact indexing of the star-wheel 4 a counter-roller 5 is provided which as seen in FIG. 2, is adapted to enter into the teeth recesses 3. The counter-roller 5 is fixed at one end of a first class lever which is spring loaded at the opposite end so as to bias the roller 5 into the teeth 3. The center of the star-wheel 4 is fixed securely at the end of a shaft 6 arranged generally perpendicular to the movemet of the track 1. A first bevel gear 7, is fixed to the shaft 6 centrally of its length, meshes with a second bevel gear 8 which is attached at the end of a flexible shaft 9 extending to and connected to the input of a pair of electrical mechanical adder registers 10 and 11.

The register 10 is a known mechanical counting device such as that shown in the aforementioned German publication and having adjustable number input wheels digital counters for presetting a given number and recording the number of coins 2 which are counted during the passage through the star-wheel. The register is capable of providing an electrical control pulse reaching the end of the preset count and/or upon reaching any predetermined number. For reasons apparent herein, the register is preferably set to provide as an output pulse when the fourth to the last coin (4 before Null) is reached in each counting cycle. In combination with the present invention, the register 10 has a switch 12 adapted to provide a pulse to operate a solenoid 13 and a switch 14 adapted to provide a pulse controlling the motor or other drive for the track 1, to stop the transport of coins along the track 1. The register 11 services as a known summation or adding counter so that the total count of coins can be obtained and displayed.

Beneath the bevel gear 7, the upper portion 15 of a coupling, generally depicted by the numeral 16, is securely fastened to the shaft. The coupling 16 includes a lower portion 16 which is mounted to freely rotate about the shaft 6 and to be axially movable along it. The lower coupling portion 18 is provided with upwardly directed teeth 19 which conform to and mate with teeth 17 depending from the upper portion of the coupling. The lower coupling portion 18 extends along the shaft 16 and is provided about its peripheral surface with a contoured crown cam 20 having a sinuous shape. The lower coupling portion 18 is integrally formed with a cylindrical extension 21 below the cam 20 which is also freely rotatable about the shaft 6 and axially movable therealong. The cylindrical portion 21 is formed with a radially extending flange 21. Mounted about the shaft 6 below the cylindrical extension 21, is a compression spring 23 which abuts against a cap secured to the lower end of the shaft. The spring 23 biases the lower coupling portion 18 in an upward direction to normally maintain the upper and lower portions of the coupling in closed condition. The shaft 6 is suitably journalled to be otherwise freely rotatable about its longitudinal axis.

A first class lever 24 is arranged tangentially to the coupling and has a cam follower roller 25 rotatably secured to one end to coact against the crown cam 20. The lever 24 pivoted in a bearing support 26 and is provided at its opposite and free end with a pivotal connection to the actuating rod of a solenoid 27. The solenoid 27 is normally deenergized but is energized by a pulse signal derived from a central control panel at the start up of operation or by the register 10, at the beginning of each cycle, or by the associated packing machine at the beginning of each cycle. As soon as the solenoid 27 is activated, it is adapted to pull in the actuating rod causing the follower roller 25 into engagement with the surface of the crown cam.

Should the engagement of the follower roller 25 be along anything but the lowest point of the contoured surface, the downward pressure exerted by the lever 24 will cause the lower coupling portion to also move downwardly on the shaft 6 resulting in a disengagement of the teeth 17 and 19 and an opening of the coupling. Simultaneously, the crown cam will cause the lower coupling portion to rotate freely about the shaft 6.

Thus, when the flange 22 is placed in a position shown in FIG. 3, i.e. in its active and not in its Null position, then the follower roller 25 coming to rest on the highest section of the crown cam 20 causes the lower coupling member 18 to so turn until it rotates to the point where the flange 22 reaches the Null position, as seen in FIG. 2. The Null position is reached as soon as the flange 22 on the cylindrical portion 21 is capable of engaging against the stop pawl 28. This position is identical to the position taken by the flange, by energizing of the solenoid 13. In order to begin over again a new counting cycle the pawl 28 is subsequently moved out of the way of flange 22 by deactivation on the solenoid 13.

It is to be noted that the alignment of the flange 22 and the low point of the crown cam 21 are irrespective of the actual engagement with the pawl 28 so that the liner 24 will cause the lower coupling member to come to rest in the Null position even without the pawl.

The counting mechanism thus described functions in the following manner. There is initially set on the register 10 the number of coins desired to be counted in any given cycle. For the purposes of illustration, it may be assumed that 25 coins are to be counted. To do so, the indicator wheels and counters are set in known manner. The counting machine is then set in operation and the coins 2 are transported sequentially on the track 1 into the respective notches or teeth of the star-wheel 4, thus causing the wheel 4 to index correspondingly. The indexing of the star-wheel 4 is controlled by the counter roller 5 so that each unit is discrete and the shaft 6 makes only a quarter rotation about its axis. Simultaneously, through the bevel gear chain 7 and 8 as well as through the flexible shaft 9 each unit of indexing of the star-wheel is transmitted to the input of the preset register 10. On the passage of the twenty first coin, i.e. four before Null, or completion of the preset count cycle, the counting wheels of the register 10 activate the switch 12 creating a pulse which is fed to the solenoid 13 thereby energizing the same. The activation of the solenoid 13 draws in its actuator rod, pivoting the pawl 28 into its stop position, as seen in FIG. 2 adjacent its cylindrical portion 21. After a further four indexings, i.e. on the passage of the twenty-fifth coin, through the star-wheel 4, the rotating flange stop 22 is carried to a point where it engages the pawl 28. As a result, the rotation of the star-wheel 4 is arrested due to the engagement of the coupling 16. The counting cycle having reached 25 coins is simultaneously ended and the transport of the coins along the track 1 is stopped by the application of a pulse from the switch 14 of the register 10 to the drive means therefor. In this position, the apparatus is at rest or in Null condition, and remains so until restarted for a new cycle.

The command for a new cycle is preferably given from the associated coin packing machine although it may be given from another suitable source. The command constitutes an electrical impulse to restart the track, for the transort of the coins, and for the release of the pawl 28, by deenergization of the solenoid 13. However, before the actual beginning of any subsequent cycle, the Null position, which is also identical to the initial starting position of the indexing wheel must be obtained to insure proper counting and indexing. This occurs automatically during reginal cycles as well as in the event the regular cycle had been interrupted. The interrupted position of the counting machine is indicated in FIG. 3 while the normal ending of the cycle is indicated in FIG. 2. In both instances a signal pulse derived from the packing machine or other source, is fed to the solenoid 27, which energizes the same and pulls the free end of the lever 24 upwardly. As a result the cam follower roller 25 engages against the crown cam 20 on the lower coupling portion 18. If it engages the high surface of the cam it pushes the coupling member downwardly, releasing its engagement with the fixed upper coupling portion 15. In the event the flange 22 stands in the position shown in FIG. 2, i.e. at the end of the regular cycle the follower roller 25 is at the lowest point of the cam surface 20 and the relative position of the radial flange 22 remains uneffected. On the other hand if the radial flange 22 is not in the Null position, as seen in FIG. 3, that is, it had been interrupted in the midst of the cycle, then the follower roller 25 acting on the curved surface of the cam 20 with sufficient force causes the lower coupling member 18 and the cylindrical portion 20 secured to it, to rotate until the flange 22 engages with the pawl 28, or reaches its Null position as indicated in FIG. 2. At this point both the solenoid 27 which controls the lever 24 and the solenoid 13 which controls the pawl 28 are deenergized and the lower coupling member 18 is forced upwardly by the action of the spring 23 until the coupling 16 reengages. The pawl 28 is thereafter pivoted out of the way of the flange 22 and the indexing star-wheel 4 is capable of being freely movable again under the action of the transported coins. At this point the new counting cycle begins it being noted, coinciding with the exact constant Null position. The manual operation of the indexing wheel is no longer necessary in order to obtain the Null position and a new counting cycle can in each instance be restarted with the counting register and star-wheel in the exact same position, both at the end of a regular cycle and also when the counting cycle has been undesirably interrupted.

The foregoing description is intended to illustrate the present invention. Various changes modifications and other embodiments have been disclosed therein, others will be readily recognized by those skilled in the present art. Accordingly, it is intended that the present disclosure be not taken as limiting of the invention.

What is claimed is:

1. Apparatus for counting coins comprising a register for recording the number of coins counted, means for transporting coins in single file, a star-wheel arranged adjacent said transporting means having teeth individually receiving a coin, said star-wheel being indexable about its central axis with respect to a null position on the passage of coins therethrough, a freely rotatable shaft fixed at one end to said star-wheel to index conjointly therewith, means for transmitting the indexing of said shaft to said register, a coupling located about said shaft, said coupling comprising a first member secured to said shaft and a second member freely rotatable about said shaft and axially movable thereon, said second coupling member having a cam located about the peripheral surface thereof and an axial extension provided with a radially extending flange, a pivotally mounted lever adapted to tangentially engage said cam, and a pivotally mounted pawl adapted to engage said flange, and means to selectively manipulate said lever to cause said lever to engage said cam to separate said coupling and cause said second coupling member to rotate into the null position about said shaft, and means to selectively manipulate said pawl to cause said pawl to engage said flange in the null position.

2. The apparatus according to claim 1 wherein said register has means for providing a first pulse on reaching a predetermined count of coins and for providing a second pulse on reaching a given member less than the predetermined count, and including means for transmitting said second pulse to means for manipulating the pawl.

3. The apparatus according to claim 1 wherein the means for manipulating the lever comprises a solenoid, the actuator arm of which is fixed to the free end of said lever.

4. The apparatus according to claim 1 wherein the means for manipulating said pawl comprises a second solenoid, the actuator arm of which is fixed to the free end of said second lever.

5. The apparatus according to claim 1 wherein the means for transmitting the indexing of said shaft to said register comprises a bevel gear received about said shaft, a flexible rod connected to said register and having a bevel gear at its free end meshing with said bevel gear on said shaft.

6. The apparatus according to claim 1 wherein said star-wheel is provided with four teeth, and said pawl is manipulated on said register reaching the fourth to the last number before the predetermined count.

* * * * *